US006736093B2

(12) United States Patent
Hammer et al.

(10) Patent No.: US 6,736,093 B2
(45) Date of Patent: May 18, 2004

(54) DEVICE FOR CONTROLLING AT LEAST ONE GAS-CHANGING OF AN INTERNAL COMBUSTION ENGINE

(75) Inventors: Uwe Hammer, Hemmingen (DE); Bjoern Schuetz, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/448,778

(22) Filed: May 29, 2003

(65) Prior Publication Data

US 2004/0040523 A1 Mar. 4, 2004

(30) Foreign Application Priority Data

Aug. 27, 2002 (DE) ..... 102 39 118

(51) Int. Cl.[7] ..... F01L 9/02

(52) U.S. Cl. ..... 123/90.12; 123/90.15; 123/90.19; 123/90.24; 251/28; 251/30.05

(58) Field of Search ..... 123/90.12, 90.15, 123/90.19, 90.24; 251/28, 30.02, 30.05, 53; 92/1

(56) References Cited

U.S. PATENT DOCUMENTS 6,321,703 B1 * 11/2001 Diehl et al. ..... 123/90.12

FOREIGN PATENT DOCUMENTS

DE 198 26 047 A1 12/1999
DE 102 01 167 A1 5/2003

* cited by examiner

*Primary Examiner*—Thomas Denion
*Assistant Examiner*—Kyle Riddle
(74) *Attorney, Agent, or Firm*—Michael J. Striker

(57) ABSTRACT

A device for controlling at least one gas-changing valve (10) of an internal combustion engine includes a valve adjuster (20) with an adjusting piston (16) limiting two pressure chamber (17, 18). The lower pressure chamber (18) is permanently acted upon by fluid pressure and the upper pressure chamber (17) can be interchangeably pressurized or depressurized with the fluid pressure. The braking of the adjusting piston (16) before reaching its upper end position affecting the closing position of the gas-changing valve, the return (22) of the upper pressure chamber (17) is divided into at least two axially spaced run-off openings (221, 222), of which the lower run-off opening (222) can be closed by the adjusting piston (16) and the upper run-off opening (221) is connected with the lower run-off opening (222) via a throttle opening (23) controllable in an opening cross section. For a temperature-independent braking action of the throttle opening (23), a temperature-controlled, pressure-regulating valve (40) is provided for adjusting the control pressure on the throttle opening (23).

10 Claims, 2 Drawing Sheets

DEVICE FOR CONTROLLING AT LEAST ONE GAS-CHANGING OF AN INTERNAL COMBUSTION ENGINE

BACKGROUND OF THE INVENTION

The present invention relates to a device for controlling at least one gas-changing valve of an internal combustion engine.

A known device of this type (DE 198 26 047 A1) has as a valve adjuster or as an actor or actuator a double-action, hydraulic working cylinder, in which an adjusting piston is axially and displaceably guided, which is fixedly connected with the valve shaft of the gas-changing valve integration in the combustion cylinder or itself, forms its end remote from the valve-closing member. The adjusting piston defines a lower and upper pressure chamber in the working cylinder with both of its front faces turned from one another. The lower pressure chamber, via which a piston displacement in the direction of the valve closing is affected, is constantly acted upon by pressurized fluid. The upper chamber, which has a supply and return, via which a piston displacement in the direction of the valve opening is affected, is acted upon by pressurized fluid via the supply, or via the return, is again released to the approximate ambient pressure with the assistance of control valves, preferably 2/2 way magnet valves. The pressurized fluid is run from a regulated pressure supply. Of the control valves, a first control valve connects the second pressure chamber with the pressure supply and a second control valve connected the upper pressure chamber with a release line opening into a fluid reservoir. In the closed state of the gas-changing valve, the upper pressure chamber is separated by the closed first control valve from the pressure supply and is connected with the release line by the opened second control valve, so that the adjusting piston is transported by the prevailing fluid pressure in the lower pressure chamber into its closed position. For opening of the gas-changing valve, the control valves are actuated, whereby the upper pressure chamber is locked from the release line and is connected to the pressure supply. The gas-exchange valve opens, since the active surface of the adjusting piston is greater in the upper pressure chamber than the active surface of the adjusting piston in the lower chamber, whereby the size of the opening stroke depends on the form of the electrical control signal on the first control valve and the opening speed of the fluid pressure controlled from the pressure supply. For closing of the gas-changing valve, the control valves again switch. Thereby, the locked upper pressure chamber opposite the pressure supply lies on the release line, and the fluid pressure prevailing in the lower pressure chamber guides the adjusting piston back into its upper end position, so that the gas-changing valve is closed by the adjusting piston.

With such a device, the requirements exist of a fast closing of the gas-changing valve and, simultaneously, a minimal striking velocity of the valve closing member on the valve seat, which, from threshold values determined on noise and wear grounds, may not be exceeded.

In this connection, it has already been proposed (DE 102 01 176.2) to use a valve brake, which is coupled with the valve closing member of the gas-changing valve or with the valve adjuster. The valve brake, which is active during a remaining closing stroke of the valve closing member, has a hydraulic damping member with a fluid displacement volume flowing off via an opening cross section of a throttle opening. In a form of the damping member integrated in the valve adjuster, the return of the upper pressure chamber is separated into two run-off openings connected to one another and arranged axially spaced in the housing, from which the upper run-off opening is associated with a restrictor and the lower run-off opening is position in the displacement path of the adjusting piston, such that it is displaceable from this before reaching the upper end position. The opening cross section of the throttle opening of the restrictor is adjusted with a pressure-controlled throttle. Its control pressure is adjusted by means of an electrically controlled, hydraulic pressure valve and an electronic control apparatus that controls the pressure valve in dependence on the viscosity of the displacement volume. This has the advantage that the valve closing member, moved in the closing direction of the gas-changing valve quickly by the valve adjuster is abruptly braked shortly before reaching the closing position of the gas-changing valve, whereby the braking action is independent from the temperature and the viscosity of the fluid volume displaced over the throttle opening. Since the opening cross section of the throttle opening is reduced with increasing temperature, and therewith, lowered viscosity by the control, the flow speed of the displaced fluid volume is reduced through the throttle opening, so that the amplitude of the braking of the adjusting piston by the damping member remains approximately constantly independent from the instantaneous viscosity of the fluid volume. For adjustment of the throttle opening, the output signal of a temperature sensor that measures the temperature of the fluid displacement volume is supplied to the electronic control apparatus that controls the hydraulic pressure regulating valve. In the control apparatus, a first characteristic line providing the functional connection between the opening cross section of the restrictor and the hydraulic control pressure on the throttle member, a second characteristic line providing the functional connection between viscosity and hydraulic control pressure, as well as a third characteristic line providing the functional dependent of the viscosity of the temperature are stored. From these three characteristic lines, the control signal for the hydraulic pressure is derived in dependent on the measuring signal of the temperature sensor.

SUMMARY OF THE INVENTION

The device of the present invention for controlling at least one gas-changing valve of an internal combustion engine has the advantage that the control pressure for adjusting of the opening cross section of the throttle opening for the purpose of maintenance of a constant flow speed, which is independent from the viscosity of the fluid, of the fluid volume displaced from the upper pressure chamber with the assistance of a temperature-dependent actor, for example, an elastic-material element, bimetal, or the like, is directly generated in dependent on the temperature. In this manner, no expensive, electronic control apparatus and no electrical cabling is required. The pressure-regulating valve that is temperature-controlled from the actor is adjusted with the opening cross section of the throttle opening, such that a desired dependency of the opening cross section from the fluid temperature is achieved.

DETAILED DESCRIPTION OF THE PREFERRED EMBODIMENTS

Figure 1:
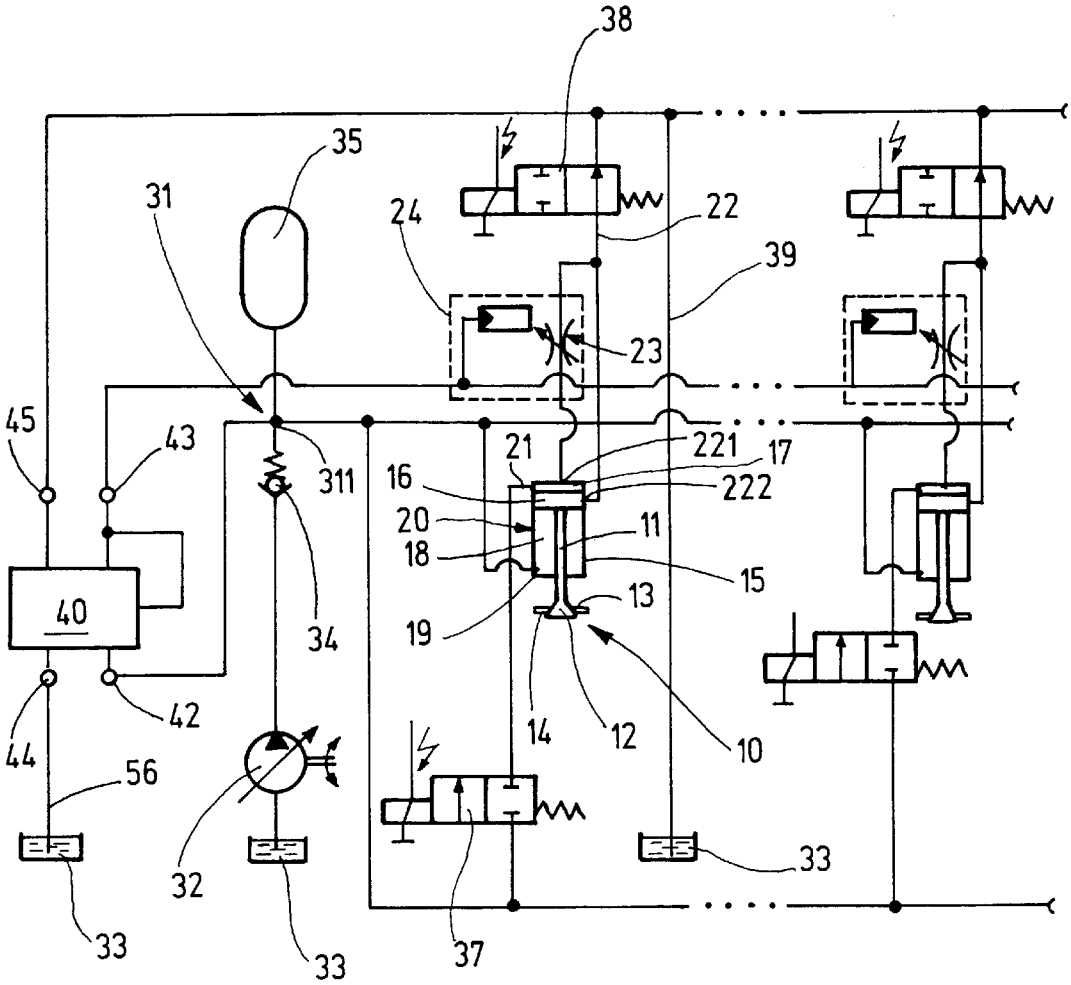
FIG. 1 is a schematic diagram of a device for controlling at least one gas-changing valve of an internal combustion engine.

The device shown in a schematic diagram in FIG. 1 serves for controlling at least one gas-changing valve 10 of at least one combustion cylinder of an internal combustion engine or a combustion engine in motor vehicles. In the schematic diagram of FIG. 1, two gas-changing valves 10 are shown, which are controlled by the device; however, the number of the gas-changing valves 10 can be increased for one or more combustion cylinders.

Each of the gas-changing valves 10 only schematically shown in FIG. 1 has a valve shaft 11 and a valve closing member 12 formed from the valve shaft, which cooperates with a valve seat 14 surrounding a valve opening 13 arranged in the cylinder head of the internal combustion engine for opening and closing of the valve opening 13.

For operation of the gas-changing valves 10, each gas-changing valve 10 is associated with a hydraulically operated valve adjuster 20, also called an actuator or actor, which is represented by a doubled-action working cylinder with a housing 15 and an adjusting piston 16 displaceably accommodated therein. The adjusting piston 16 is connected fixedly with the valve shaft 11 and holds the gas-changing valve 10 closed in the displacement end position of FIG. 1 (hereinafter designated as the upper end position), and holds the gas-changing valve 10 maximally opened in a lower end position. The adjusting piston 16 defines two volume-variable pressure chambers 17, 18 in the housing 15 axially with different sized active surfaces, whereby the active surface, which define the upper pressure chamber 17 in FIG. 1, is greater than the active surface that defines the lower pressure chamber 18 in FIG. 1. The lower pressure chamber 18 has a fluid connecting 19 and the upper pressure chamber 17 has a supply 21 for an in-flowing fluid volume and a return 22 for an out-flowing fluid volume. The supply 21 is arranged in the housing 15 above the upper end position of the adjusting piston 16. The return 22 is subdivided into two run-off openings 221, 222 axially spaced in the housing 15. The upper run-off opening 221, likewise, lies like the supply 21 above the upper end position of the adjusting piston 16, while the lower run-off opening 222 is arranged such that it is closed by the adjusting piston 16 with distance before reaching the upper end position. The upper run-off opening 221 is connected with a lower run-off opening 222 having a controllable opening cross section. The opening cross section of the throttle opening 23 is, as previously described, adjustable by means of a control pressure, which is generated on its side by means of a pressure-controlled pressure-regulating valve.

Figure 2:
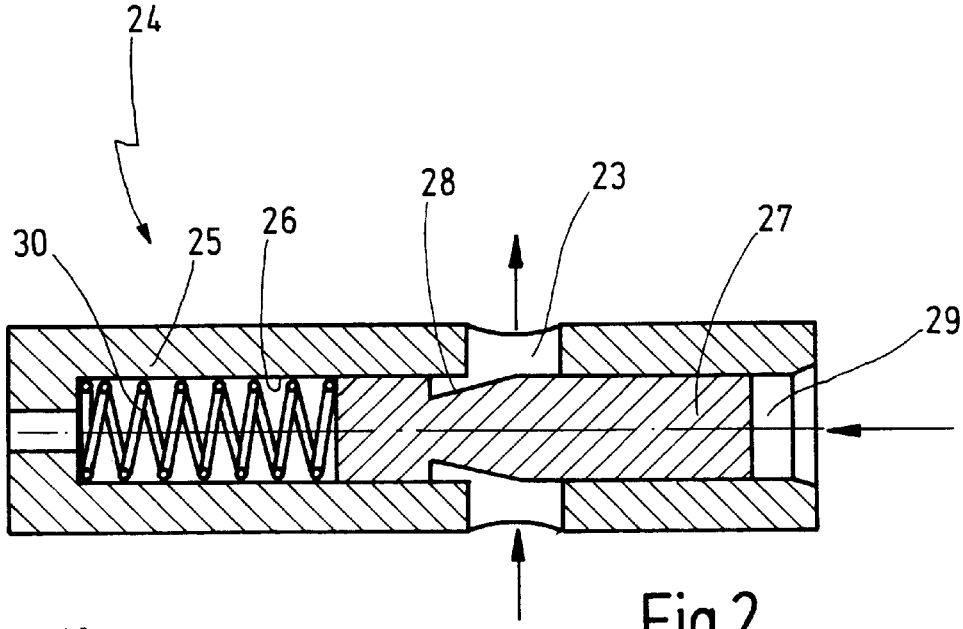
FIG. 2 is a longitudinal section of a pressure-controlled throttle member in the device according to FIG. 1.

The throttle opening 23 is part of a pressure-controlled throttle 24, such as that shown in longitudinal section in FIG. 2. This has a cylindrical throttle body 25 with a blind hold-type longitudinal bore 26, as well as a control slider 27 that is axially displaceable in the longitudinal bore 26. The throttle opening 23 is inserted in the form of a diametric through-bore in the throttle body 25, which crosses the longitudinal bore 26. The control slider 27 supports a revolving control edge 28 that cooperates with the throttle opening 23 and defines a control pressure chamber 29 with one of its front sides. Between the base of the longitudinal bore 26 and the control slider 27, a pressure spring, formed as a restoring spring, is braced, which transports the control slider 27 into a base position with a pressure-less control pressure chamber 29, in which the control slider 27 maximally opens the throttle opening 23. With increasing control pressure in the control pressure chamber 29, the control slider 27 is displaced to the left against the restoring force of the restoring spring 30, as shown in FIG. 2, and thereby, the opening cross section of the throttle opening 23 is increasingly reduced.

Each valve adjuster 20 for a gas-changing valve 10 is associated with a pressure-controlled throttle 24, as well as a first control valve 37 and a second control valve 38, both of which are formed as 2/2-way magnet valves with spring return. All valve adjusters 20 are fed by a pressure supply device with a fluid standing under high pressure. The pressure supply device 31 includes a preferably regulatable high pressure pump 32, the fluid, preferably hydraulic oil, supplied from a fluid reservoir 33, a check valve 34, and a pressure storage 35 for pulsation damping and energy storage. On the outlet 311 of the pressure supply device 31, the highly-pressurized fluid can be removed.

Of each valve adjuster 20, the lower pressure chamber 18 is connected via its fluid connection 19 with the outlet 311 of the pressure supply unit 31, so that the lower pressure chamber 18 is permanently acted upon by high pressure. The supply 21 of the upper chamber 17 is connected with the outlet 311 of the pressure supply device 31 via the first control valve 37. The return 22 of the upper pressure chamber 17, that is, the connecting point of the upper and lower run-off opening 221 and 222, is connected to a return line 39 via a second control valve 38. Depending on the position of the two control valves 37, 38, the upper pressure chamber 17 is acted upon by pressure or pressure-released.

Figure 3:
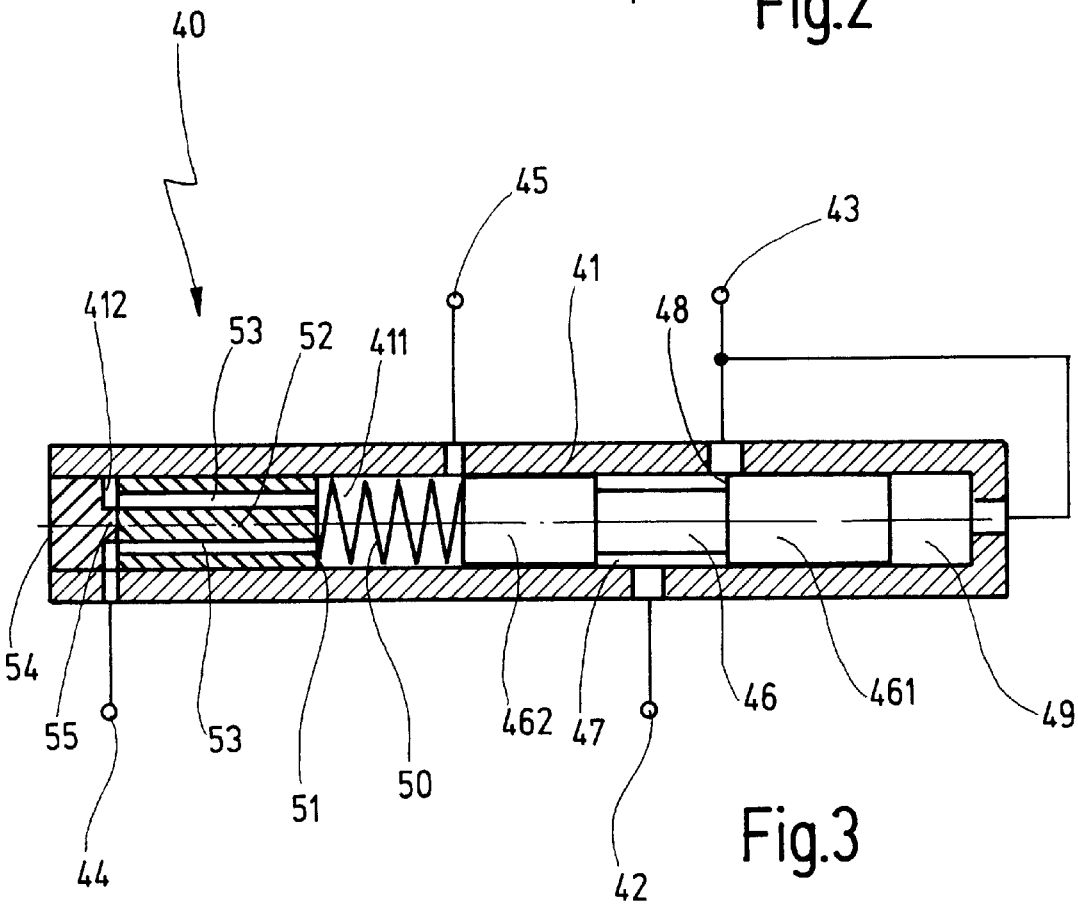
FIG. 3 is a longitudinal section of a temperature-controlled pressure-regulating valve in the device according to FIG. 1.

The control pressure chamber 29 of each pressure-controlled throttle 24 is connected with the temperature-controlled pressure-regulating valve 40. The pressure regulating valve 40 is schematically represented in FIG. 3 in longitudinal section. It has a valve housing 41 with a valve inlet 42 and a valve outlet 43, as well as two connection openings 44, 45 for the flow-through of a fluid flow branching off from the return line 39. An axially displaceable regulating piston 46 in the valve housing 41 is formed as a tandem piston with two piston sections 461, 462 spaced from one another and rigidly connected to one another. The piston sections 461, 462 define together with the valve housing 41 a valve chamber, into which the valve inlet and valve outlet 43 open. The valve chamber 47 is defined on a front side by a regulating edge or controlling edge 48 on the regulating piston 46, which adjusts the opening cross section of the valve outlet 43. The piston section 461 defines with its free front face a pressure chamber 49, which is connected to the valve outlet 43. The piston section 462 is braced with its free front faced on a pressure spring 50, which, on its side, with its other end that is remote from the regulating piston, is braced on a thrust bearing 51 in a valve housing and that is axially displaceable in its borders. The thrust bearing 51 is part of a temperature element 52, which, for example, is an elastic-material element or a bimetal element and upon changing temperatures, its axial length is enlarged or reduced. The temperature element 52 is provided with axial throughbores 53, which, on one side, open in the housing section 411 receiving the pressure spring 50 and, on the one side, open into a closed, ring-shaped housing section 412 that is sealed to be water-tight by a sealing plug 54. The connection opening 45 opens into the housing section 411 and the connection opening 44 opens into the housing section 412, so that fluid flowing from the connection opening 44 to the connection opening 45 flows through the temperature element 52 and the temperature element 52 determines the temperature of the fluid. The sealing plug 54 can be screwed in an inner threading in the valve housing 41 with an outer threading (not shown) and supports indirectly an axially projecting adjusting tappet 55, on which the temperature element 52 is pressed from the spring force of the pressure spring 50. By means of more or fewer rotations of the sealing plug 54 into the valve housing 41, the temperature element 52 can be slipped more or less deeply into the housing section 411 and, therewith, the pressure spring 50 can be tensioned more or less.

The valve inlet 42 is connected with the outlet 311 of the pressure supply device 31, while, on the valve outlet 43, all control pressure chambers 29 of the pressure-controlled throttles 24, are connected. The connection opening 45 is connected with the return line 39, and the connection opening 44 is guided over a line 56 to the fluid reservoir 33. With a correspondingly large cross section, the through bores 53 in the temperature element 52 can actuate the two connection openings 44, 45 also directly in the return line 39, that is, the entire return flow can be guided to the fluid reservoir 33 via the temperature element 52.

The manner of functioning of the described device is as follows:

As shown in FIG. 1, the first control valve 37 is closed and the second control valve 38 is opened. The high pressure in the lower pressure chamber 18 serves to ensure that the adjusting piston 16 is located in the upper end position and thereby, the valve closing member 12 sits on the valve seat 14 in a manner sealed from gas, and the gas changing valve 10 is closed. If the control valves 37, 38 are changed or switched, then the upper pressure chamber 17 is locked from the return line 39 and the high pressure on the outlet 311 of the pressure supply unit 31 is placed on the upper pressure chamber 17. As a result, the larger active surface of the adjusting pistons defining the upper pressure chamber 17 moves the adjusting piston 16 in FIG. 1 downward and the gas-changing valve 10 opens.

For the closing process of the gas-changing valve 10, the control valves 37, 38 are again switched into the position shown in FIG. 1, so that the fluid-filled upper pressure chamber 17 is locked from the pressure supply unit 31 and is connected to the return line 39, and therewith, is pressure-released. The adjusting piston 16 that is moved upward from the pressure in the lower control chamber 18 displaces the fluid volume from the upper pressure chamber 17 via the lower run-off opening 222, and, if also in a reduced amount, out via the throttled upper run-off opening 221. As soon as the adjusting piston 16 closes the lower run-off opening 222, the fluid can only flow off via the upper run-off opening 221 and the throttle opening 23, whereby the out-flow speed of the fluid from the upper pressure chamber 17 is reduced and the adjusting piston 16 moves only with a reduced speed in its upper end position. In this manner, the speed, with which the valve closing member 12 is moved on the valve seat 14 likewise is reduced shortly before reaching the valve seat 14, and the valve closing member 12 sets on the valve seat 14 with a considerably reduced end speed for closing the gas-changing valve 10.

The flow speed of the fluid through the throttle opening 23 is dependent on the viscosity of the fluid. If the fluid has a large viscosity, then a smaller fluid volume flows through an equally large throttle opening 23 per unit time as with a smaller viscosity. Upon heating of the fluid, its viscosity is reduced, so that the displacement of the fluid volume via the throttle opening 23 takes place with a higher flow speed, and therewith, the valve member is less intensely braked, before it is seated on the valve seat 14. In order to compensate and ensure that with all operating temperatures the gas-changing valve 10 closes with a constant contact speed of the valve member 12, by means of this temperature-dependency of the braking action on the viscosity of the fluid, the opening cross section of the throttle opening 23 is changed by a suitable control pressure of a temperature-controlled pressure-regulating valve 40, such that it provides a constant flow speed of the fluid through the throttle opening 23. If the viscosity of the fluid is reduced as a result of an increase in temperature, then the control pressure in the control pressure chamber 29 increases, whereby the control slider 27 of the throttle 24 in FIG. 2 is displaced to the left and the control edge 28 of the throttle opening 23 increasingly closes.

The function of the temperature-controlled pressure-regulating valve 40 in shown in FIG. 3 is as follows:

In the state of the pressure-regulating valve 40 shown in FIG. 3, fluid moves from the valve inlet 42 via the valve outlet 43 into the control pressure chamber 29 of the closed pressure-controlled throttle 24. The pressure on the valve outlet 43 causes an axial displacement force in the pressure chamber 49 on the regulating piston 46. At a determined outlet pressure, the force on the regulating piston is so large that the pressure spring 50 is compressed together and the valve outlet 43 is partitioned off always more strongly by the regulating edge 48. Now, only minimal fluid can blow off over the valve outlet 43. In this manner, the fluid pressure on the valve outlet 43 is reduced, and therewith, in the pressure chamber 49, and the pressure spring 50 pressure the regulating piston 46 to the right, so that the valve is again controlled and more fluid flows from the valve inlet 42 via the valve outlet 43 to the throttle 24. The position of the regulating piston 46 adjusts itself always, then, so that a balance exists between the spring force of the pressure spring 50 and the force produced by the pressure on the valve outlet 43 or in the pressure chamber 49. If this balance is disturbed, the regulating piston is blocked until the balance again is made. By means of the force of the pressure spring 50, the pressure on the valve outlet 43 can be adjusted. The higher the force of the spring 50, the greater the pressure on the valve outlet 43, and therewith, the pressure in the control pressure chamber 29 of the pressure-controlled throttle 24.

By means of the temperature element 52, whose length changes by temperature changes in a sufficiently large amount, it is achieved that the control pressure is regulated in a temperature-dependent manner. Based on the flow-through of the temperature element 52 through the fluid coming from the return line 39, the temperature element 52 takes approximately the same temperature as the fluid. The length of the temperature element 52 and therewith, the housing section 411 representing the structural space for the pressure spring 50 changes in dependence on the fluid temperature. The force of the pressure spring 50 changes as a result of the change of the structural space, and the change of the force of the pressure spring 50 causes the control pressure to change in the described manner, that is, with lower fluid temperatures, a smaller control pressure, and with higher fluid temperatures, a greater control pressure is controlled on the valve outlet 43. With the assistance of the sealing plug 54 that can be screwed in and the adjusting member formed as an adjusting tappet 55, the temperature member 52 in the valve housing 41 can be axially displaced and therewith, the tensioning force of the pressure spring 50 is adjusted, so that with a determined temperature, a determined force of the pressure spring 50 occurs and a determined control pressure is adjusted on the valve outlet 43. The change of the control pressure in dependence on the temperature is achieved with the assistance of the determination of the temperature-dependent change in length of the temperature element 52 with the characteristic line of the pressure spring 50.

It will be understood that each of the elements described above, or two or more together, may also find a useful application in other types of constructions differing from the types described above.

While the invention has been illustrated and described herein as a device for controlling at least one gas-changing valve of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Device for controlling at least one gas-changing valve (10) of an internal combustion engine, with at least one valve adjuster (20) coupled with a gas-changing valve (10) for its operation, which has an adjusting piston (16) axially-displaceably accommodated in a housing (15), the adjusting piston (16) closing the associated gas-changing valve (10) in an upper end position and maximally opening the associated gas-changing valve (10) in a lower end position, and two pressure chambers (17, 18) axially defined by the adjusting piston (16) and having different sized active surfaces, of which pressure chambers, a lower pressure chamber (18) defined by a smaller active surface is permanently acted upon by fluid pressure and an upper chamber (17) defined by a larger active surface can be pressurized and depressurized by means of a supply and return (21, 22) interchangeably with the fluid pressure, characterized in that the return (22) of the upper pressure chamber (17) is divided into at least two run-off openings (221, 222) arranged axially spaced in the housing (15), of which a lower run-off opening (222) lies in a displacement path of the adjusting piston (16), such that the lower run-off opening can be displaced by the adjusting piston before reaching the end position, and an upper run-off opening (221) is connected with the lower run-off opening (222) via a throttle opening (23), whose opening cross section is adjustable by means of a control pressure, and that for adjustment of the control pressure, a temperature-controlled pressure-regulating valve (40) that puts out fluid is provided.

2. Device according to claim 1, characterized in that the throttle opening (23) is provided in the throttle body (25) of a pressure-controlled throttle (24), which has an axially displaceable control slider (27) with a control edge (28) that controls the opening cross section of the throttle opening (23), wherein the control edge (28) defines a control pressure chamber (29) with one front side and with another front side, is braced on a restoring spring, which loads the control slider (27) in a direction that is an enlargement of the opening cross section, and that the control pressure chamber (29) is connected to the temperature-controlled pressure-regulating valve (40).

3. Device according to claim 2, characterized in that the temperature-controlled pressure-regulating valve (40) has a valve inlet (42) connected to a fluid pressure and a valve outlet (43) connected with the pressure control chamber, as well as a regulating piston (46) controlling a valve inlet and a valve outlet (42, 43) and a temperature element (52), whose length changes in a temperature-dependent manner.

4. Device according to claim 3, characterized in that the regulating piston (46) is formed as a displaceable tandem piston in a valve housing (41) with two rigidly connected, spaced apart piston sections (461, 462), and that both piston sections (461, 462) define between them a valve chamber with a valve inlet (42) and a valve outlet (43) connected to one another and one of the piston sections (461) has a regulating edge (48) for closing and opening of the valve outlet (43).

5. Device according to claim 4, characterized in that one piston section (461) limits a pressure chamber (49) connected with the valve outlet (43) with a free front face and another piston section (462) lies with its free front face on a pressure spring (50) supported in a thrust bearing (51), and that the thrust bearing (51) is formed from a temperature element (52).

6. Device according to claim 4, characterized in that two connection openings (44, 45) for a fluid inflow and a fluid outlet are provided in the valve housing (41), which are connected to one another by means of a bore (53) penetrating the temperature element (52).

7. Device according to claim 5, characterized in that the temperature element (52) lies with an end that is remote from the pressure spring on an adjusting member, which can be adjusted in-the valve housing (41) in an axial direction.

8. Device according to claim 7, characterized in that the adjusting member is formed as a sealing plug (54) that can be screwed in the valve housing (41), wherein the sealing plug (54) closes the valve housing (41) with a water-tight seal on an end turned away from the pressure chamber (49) and supports an adjusting tappet (55), on which the temperature element (52) rests force-lockingly under the action of the pressure spring (50).

9. Device according to claim 6, characterized in that a pressure supply unit (31) supplying a highly-pressurized fluid is provided, that the lower pressure chamber (18) of each valve adjuster (20) is connected with the pressure supply unit (31), that each valve adjuster (20) is associated with a pressure-controlled throttle (24) and a first and second control valve (37, 38), of which the first control valve (37) connects the supply (21) of the upper pressure chamber (17) with the pressure supply unit (31) and the second control valve (38) connects the return (22) with a return line (39) opening into a fluid reservoir (33), that the valve inlet (42) of the temperature-controlled pressure-regulating valve (40) is connected to the pressure supply unit (31) and the valve outlet (43) of the temperature controlled pressure regulating valve (40) on the control pressure chamber (29) of each pressure controlled throttle (24), and that the two connecting openings (44, 45) of the temperature-controlled pressure-regulating valve (40) are integrated in the return line (39) or in a parallel branch of the return line (39).

10. Device according to claim 3, characterized in that the temperature element (52) is an elastic-material element or a bimetal element.

* * * * *